US012543860B2

(12) United States Patent
Wang et al.

(10) Patent No.: US 12,543,860 B2
(45) Date of Patent: Feb. 10, 2026

(54) ARMREST FRAME CAPABLE OF BEING COLLAPSED CONVENIENTLY

(71) Applicant: Shanghai Wudi Home Furnishings Co Ltd, Shanghai (CN)

(72) Inventors: Renjie Wang, Huzhou (CN); Guohong Lyu, Huzhou (CN); Shichao Zhou, Huzhou (CN)

(73) Assignee: Shanghai Wudi Home Furnishings Co Ltd, Shanghai (CN)

( * ) Notice: Subject to any disclaimer, the term of this patent is extended or adjusted under 35 U.S.C. 154(b) by 143 days.

(21) Appl. No.: 18/372,183

(22) Filed: Sep. 25, 2023

(65) Prior Publication Data

US 2025/0024952 A1 Jan. 23, 2025

(30) Foreign Application Priority Data

Jul. 19, 2023 (CN) ..... 202321907165.8

(51) Int. Cl.
*A47C 7/54* (2006.01)

(52) U.S. Cl.
CPC ..... *A47C 7/543* (2013.01)

(58) Field of Classification Search
CPC ..... A47C 7/54; A47C 7/541; A47C 7/543
See application file for complete search history.

(56) References Cited

U.S. PATENT DOCUMENTS 3,174,722 A * 3/1965 Alm ..... B66F 7/065 187/269
6,209,157 B1 * 4/2001 Hensley ..... A47C 20/041 5/613
6,351,861 B1 * 3/2002 Shows ..... A61G 7/0514 5/613
6,516,478 B2 * 2/2003 Cook ..... A47C 19/045 5/616
7,025,421 B1 * 4/2006 Fowler ..... A47C 3/36 297/325
8,104,725 B1 * 1/2012 Kebre ..... A01K 1/0107 248/164
9,743,776 B2 * 8/2017 Ray ..... A47C 19/045
10,314,754 B2 * 6/2019 Karwal ..... A61G 7/008
10,736,803 B2 * 8/2020 Connell ..... A61G 5/104
(Continued)

FOREIGN PATENT DOCUMENTS

CN 201070151 Y 6/2008

*Primary Examiner* — Chi Q Nguyen

(74) *Attorney, Agent, or Firm* — Bayramoglu Law Offices LLC

(57) ABSTRACT

An armrest frame capable of being collapsed conveniently is provided. The armrest frame capable of being collapsed conveniently includes an armrest frame set, scissor sets, and a locking unit, where the scissor sets are provided between the armrest frames, the scissor sets drive the armrest frames to move close to or away from each other, the scissor sets each include crisscross hinged scissor arms, and two ends of each of the scissor arms are respectively hinged to the corresponding armrest frames. The armrest frame set is used to replace the existing fixed wood frame or metal frame. In the armrest frame set, one armrest frame is fixed, while the other armrest frame is movable. The movable armrest frame can move relative to the fixed armrest frame through the scissor set, such that an armrest of a sofa can be expanded or collapsed.

8 Claims, 4 Drawing Sheets

(56) References Cited

U.S. PATENT DOCUMENTS

| | | | | |
|---|---|---|---|---|
| 10,842,701 | B2 * | 11/2020 | Paul | A61G 15/12 |
| 10,918,216 | B2 * | 2/2021 | Atkinson, Jr. | B66F 7/28 |
| 2009/0211026 | A1 * | 8/2009 | Schoff | F21V 33/0072 5/600 |
| 2020/0397147 | A1 * | 12/2020 | Ren | A47C 19/021 |

* cited by examiner

ARMREST FRAME CAPABLE OF BEING COLLAPSED CONVENIENTLY

CROSS REFERENCE TO THE RELATED APPLICATIONS

This application is based upon and claims priority to Chinese Patent Application No. 202321907165.8, filed on Jul. 19, 2023, the entire contents of which are incorporated herein by reference.

TECHNICAL FIELD

The present disclosure relates to the technical field of armrest frame structures of sofas, and in particular to an armrest frame capable of being collapsed conveniently.

BACKGROUND

A typical sofa includes a seat cushion, a backrest, a body, and an armrest. Currently, the sofa size cannot be changed after assembly, apart from detaching the seat cushion and backrest. At present, the expense for shipping containers in the export of furniture is greatly increased, and this is particularly the case for large furniture. Hence, furniture enterprises are trying to downsize the sofa.

The Chinese Patent Application No. CN200720121996.7 specifically provides for a sofa that includes a shape-adjustable body as well as a seat cushion, a backrest and an armrest that are arranged on the body. The bendable seat cushion is provided on a seat of the body and a collapsible leg support frame. On the packaging surface of the seat cushion with the seat of the body and the collapsible leg support frame, a connector for connecting and locating the seat cushion and the body is provided correspondingly. By correspondingly providing the connector for connecting and locating the seat cushion and the body on the packaging surface of the bendable seat cushion with the seat of the body and the collapsible leg support frame, when the seat cushion is adjusted with the shape of the body, not only are the location and connection of the seat cushion and the body unaffected, but also the packaging surface of the sofa can be detached for washing.

According to the technical solution in the above patent, however, only the seat cushion and the backrest are detachable, and the sofa cannot be downsized.

SUMMARY

In view of the above problem, the present disclosure provides an armrest frame capable of being collapsed conveniently. The armrest frame set is used to replace the existing fixed wood frame or metal frame. In the armrest frame set, one armrest frame is fixed, while the other armrest frame is movable. The movable armrest frame can move relative to the fixed armrest frame through a scissor set, such that an armrest of a sofa can be expanded or collapsed. While reducing a shipping size of the sofa, the present disclosure saves a material of the sofa and has a lower cost.

To achieve the above objective, the present disclosure provides the following solution:

An armrest frame capable of being collapsed conveniently includes:

an armrest frame set, scissor sets, and a locking unit, where the armrest frame set includes two parallel and vertically provided armrest frames;

the scissor sets are provided between the armrest frames, the scissor sets drive the armrest frames to move close to or away from each other, the scissor sets each include crisscross hinged scissor arms, and two ends of each of the scissor arms are respectively hinged to the corresponding armrest frames; and the locking unit is provided at a hinged position for the armrest frame and the scissor arm, and the locking unit locks the expanded armrest frame set.

As an improvement, the armrest frame is shaped as a square frame or a square plate.

As an improvement, there are two symmetrical scissor sets.

As an improvement, the scissor arm includes a first scissor arm with a hinged central position and a second scissor arm.

As an improvement, the scissor arm includes a first scissor arm with a hinged central position and two second scissor arms, and the second scissor arms are symmetrically provided at two sides of the first scissor arm.

As an improvement, an adjusting groove is formed at a position of one end of each of the first scissor arm and the second scissor arm hinged to the armrest frame, and the locking unit is provided at the adjusting groove of the second scissor arm.

As an improvement, the locking unit includes a clamping jaw and a locating post;

the clamping jaw is swingably provided on the scissor arm, and a spring member for driving the clamping jaw to reset is provided on the clamping jaw; and the locating post is provided on the armrest frame, and after the locating post and the clamping jaw are located cooperatively, the armrest frame is fixed.

As an improvement, a clamping groove correspondingly cooperated with the locating post is formed in the clamping jaw, the clamping groove is shaped as a semicircle, and the clamping jaw is provided with a protrusive limiting portion from the clamping groove to an extension direction of the corresponding scissor arm.

As an improvement, the locating post is located at the hinged position for the scissor arm and the armrest frame.

The present disclosure has the following beneficial effects:

(1) The armrest frame set is used to replace the existing fixed wood frame or metal frame. In the armrest frame set, one armrest frame is fixed, while the other armrest frame is movable. The movable armrest frame can move relative to the fixed armrest frame through the scissor set, such that an armrest of a sofa can be expanded or collapsed. While reducing a shipping size of the sofa, the present disclosure saves a material of the sofa and has a lower cost.

(2) The armrest frame is expanded or collapsed through the scissor set. The expanded armrest frame is locked by the locking unit, such that the armrest of the sofa is not collapsed automatically.

Therefore, the present disclosure makes the size of the sofa adjustable, and reduces the material cost of the sofa. The present disclosure is particularly applied to the technical field of armrest structures of sofas.

DETAILED DESCRIPTION OF THE EMBODIMENTS

Figure 1:
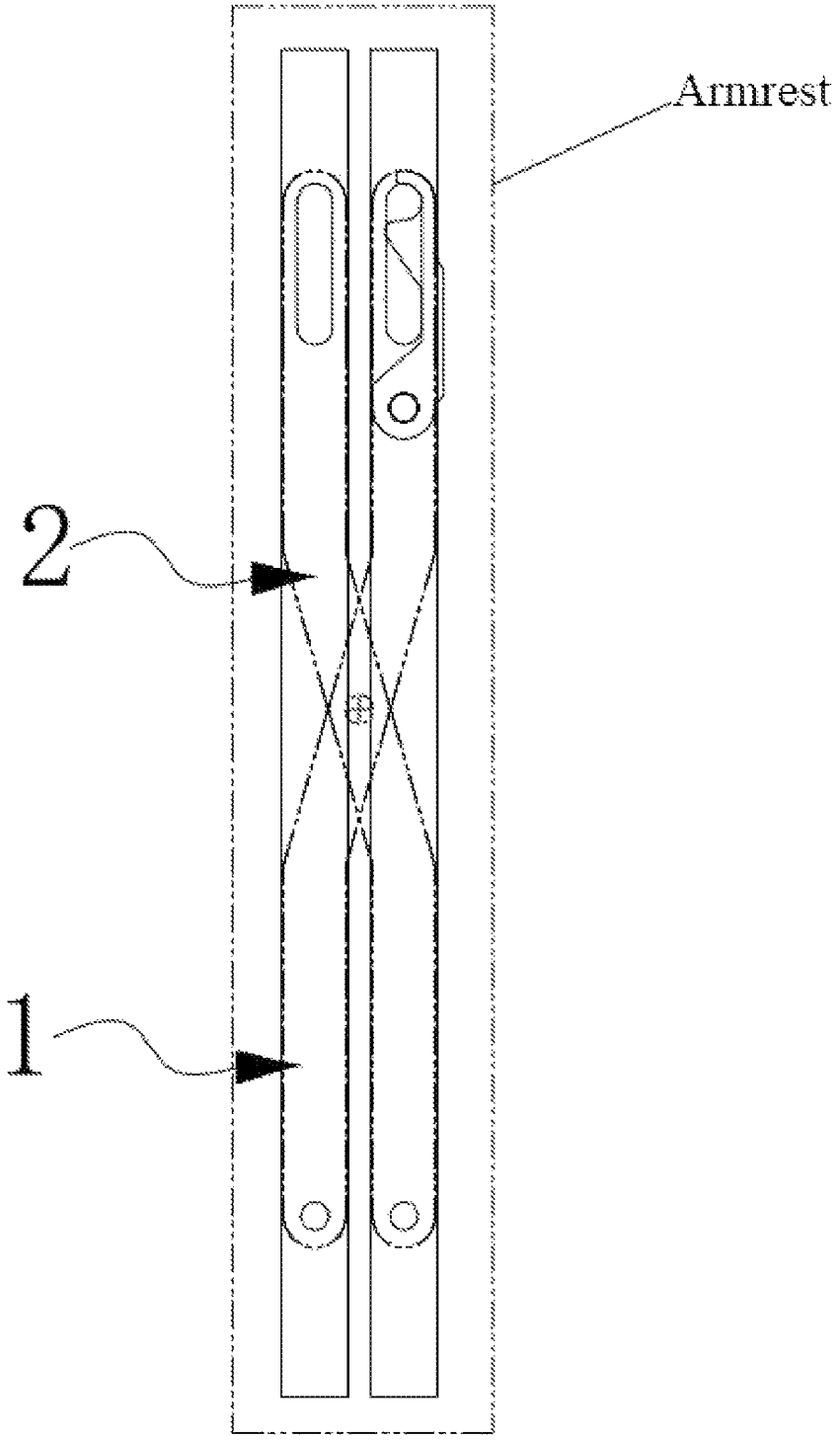
FIG. 1 is a schematic view of a collapsed structure of an armrest frame set according to Embodiment 1 of the present disclosure.
Figure 2:
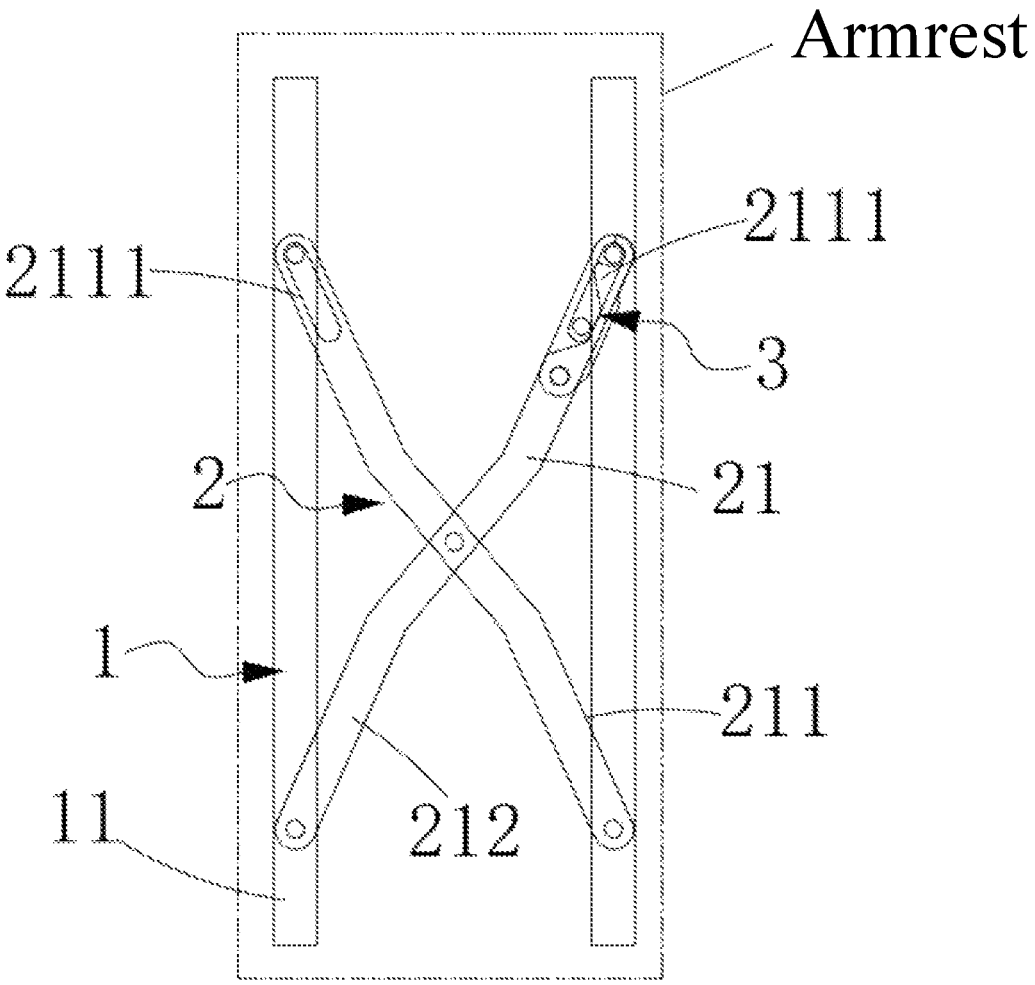
FIG. 2 is a schematic view of an expanded structure of an armrest frame set according to Embodiment 1 of the present disclosure.

The technical solutions in embodiments of the present disclosure will be described below clearly and completely with reference to the accompanying drawings in the embodiments of the present disclosure. Apparently, the described embodiments are merely some, rather than all of the embodiments of the present disclosure. All other embodiments derived from the embodiments of the present disclosure by those of ordinary skill in the art without creative efforts shall fall within the protection scope of the present disclosure.

It should be understood that, in the description of the present disclosure, the terms such as "central", "longitudinal", "transverse", "length", "width", "thickness", "upper", "lower", "front", "back", "left", "right", "vertical", "horizontal", "top", "bottom", "inner", "outer", "clockwise", "anticlockwise" are intended to indicate orientations shown in the drawings. It should be noted that these terms are merely intended to facilitate a simple description of the present disclosure, rather than to indicate or imply that the mentioned apparatus or elements must have the specific orientation or be constructed and operated in the specific orientation. Therefore, these terms may not be construed as a limitation to the present disclosure.

In addition, the terms "first" and "second" are merely intended for a purpose of description, and shall not be understood as an indication or implication of relative importance or implicit indication of a quantity of indicated technical features. Thus, features defined with "first" and "second" may explicitly or implicitly include one or more of the features. In the description of the present disclosure, the term "a plurality of" means two or more, unless otherwise specifically defined.

Embodiment 1

As shown in FIG. 1 to FIG. 5, an armrest frame capable of being collapsed conveniently includes:

armrest frame set 1, scissor sets 2, and locking unit 3.

The armrest frame set 1 includes two parallel and vertically provided armrest frames 11.

The scissor sets 2 are provided between the armrest frames 11. The scissor sets 2 drive the armrest frames 11 to move close to or away from each other. The scissor sets 2 each include crisscross hinged scissor arms 21. Two ends of each of the scissor arms 21 are respectively hinged to the corresponding armrest frames 11.

The locking unit 3 is provided at a hinged position for the armrest frame 11 and the scissor arm 21. The locking unit 3 locks the expanded armrest frame set 1.

The armrest frame 11 is shaped as a square frame or a square plate.

The scissor arm 21 includes first scissor arm 211 with a hinged central position and second scissor arm 212.

Specifically, adjusting groove 2111 is formed at a position of one end of each of the first scissor arm 211 and the second scissor arm 212 hinged to the armrest frame 11. The locking unit 3 is provided at the adjusting groove 2111 of the second scissor arm 212.

More specifically, the locking unit 3 includes clamping jaw 31 and locating post 32.

The clamping jaw 31 is swingably provided on the scissor arm 21. A spring member for driving the clamping jaw to reset is provided on the clamping jaw 31.

The locating post 32 is provided on the armrest frame 11. After the locating post 32 and the clamping jaw 31 are located cooperatively, the armrest frame 11 is fixed.

Clamping groove 312 correspondingly cooperated with the locating post 32 is formed in the clamping jaw 31. The clamping groove 312 is shaped as a semicircle. The clamping jaw 31 is provided with protrusive limiting portion 313 from the clamping groove 312 to an extension direction of the corresponding scissor arm 21.

In addition, the locating post 32 is located at the hinged position for the scissor arm 21 and the armrest frame 11. The locating post 32 and a hinge shaft at the hinged position are formed into a whole.

It is to be noted that for the two parallel and vertically provided armrest frames 11, one armrest frame is fixedly provided on a sofa body, while the other armrest frame is movably provided. When the armrest is to be expanded as required, the scissor set 2 drives the movable armrest frame 11 to move. In movement, an included angle between the first scissor arm 211 and the second scissor arm 212 in the scissor set 2 is gradually increased, such that the movable armrest frame 11 moves relative to the fixed armrest frame 11. After the movable armrest frame 11 moves in place, the locking unit 3 locks the scissor set 2 and the armrest frame 11, thereby fixing the armrest frame 11.

It is further to be noted that the locking unit 3 has a following working principle: After the scissor set 2 is expanded in place, the clamping jaw 31 in the locking unit 3 clamps the locating post 32. The spring member applies a spring force to the clamping jaw 31, such that the armrest frame 11 is fixed with the scissor set 2. When the armrest is to be collapsed, the armrest is manually squeezed, and the clamping groove 312 on the clamping jaw 31 is stressed, such that the limiting portion 313 passes through the locating post 32, and the clamping jaw 31 is separated from the locating post 32. Therefore, the armrest frame 11 and the scissor set 2 are unlocked.

Embodiment 2

Figure 3:
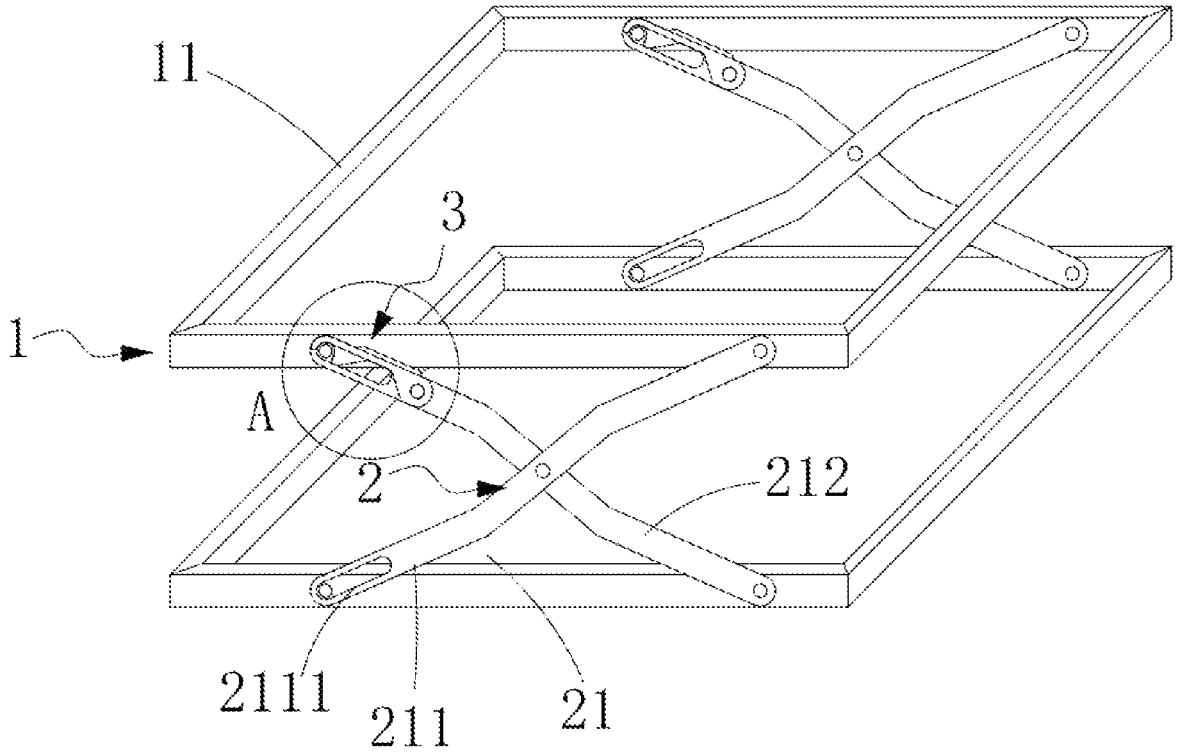
FIG. 3 is a schematic view of a perspective structure of an armrest frame set according to Embodiment 1 of the present disclosure.
Figure 4:
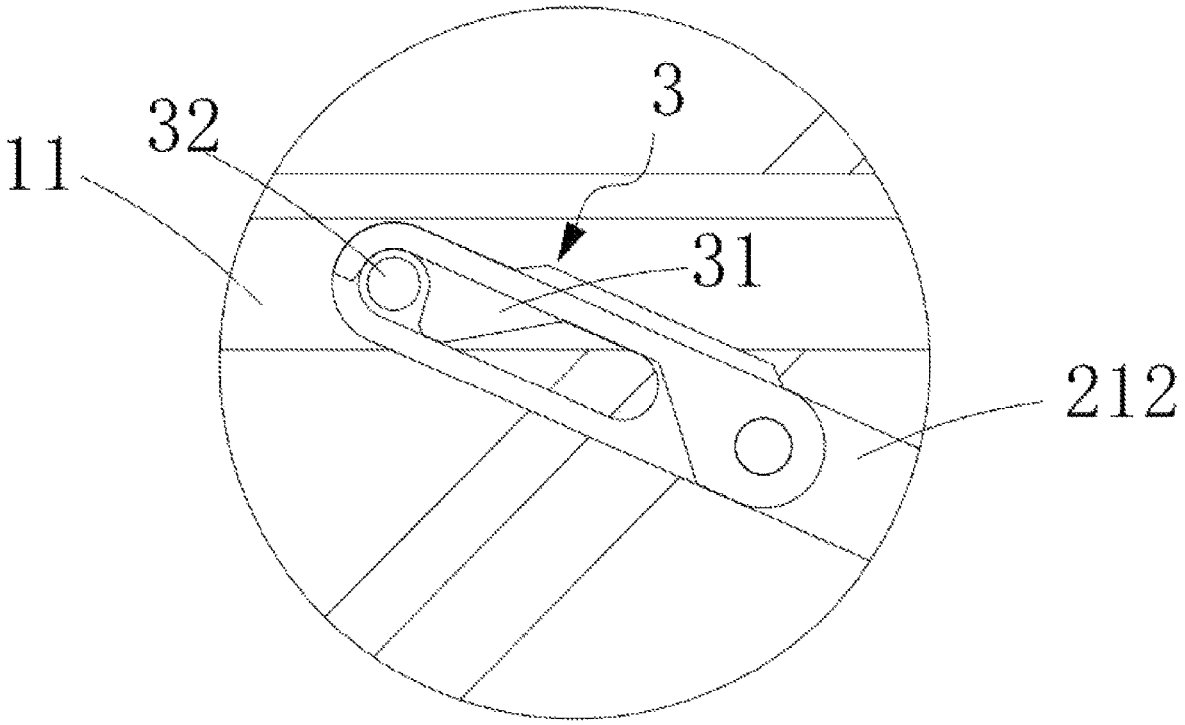
FIG. 4 is an enlarged view of a structure at A shown in FIG. 3.
Figure 5:
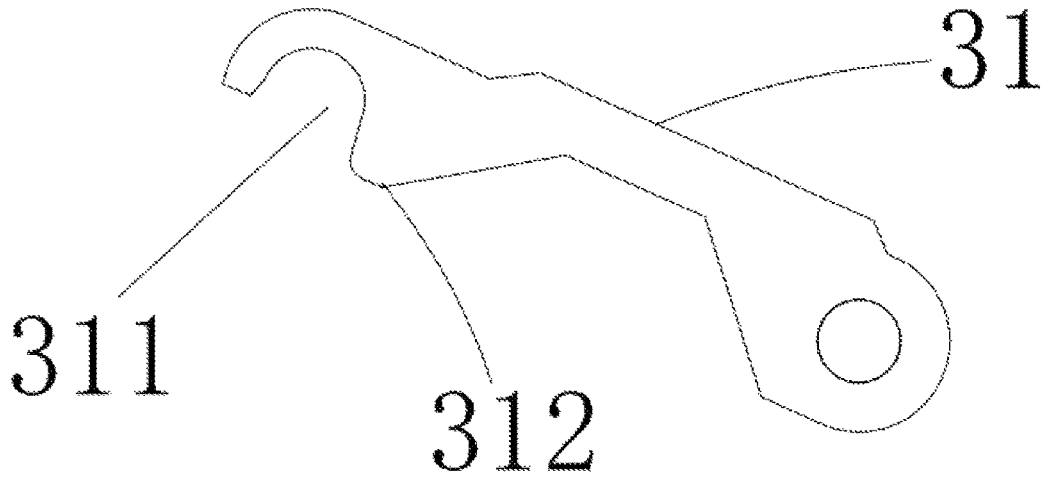
FIG. 5 is a schematic view of a perspective structure of a clamping jaw according to the present disclosure.

With reference to the description on Embodiment 1, Embodiment 2 differs from Embodiment 1 in:

As shown in FIG. 3, there are two symmetrical scissor sets 2. With the two scissor sets 2, the armrest frame 11 is stressed more uniformly, and the armrest frame 11 is expanded and collapsed more stably.

Embodiment 3

With reference to the description on Embodiment 1, Embodiment 2 differs from Embodiment 1 in:

The scissor arm 21 includes first scissor arm 211 with a hinged central position and two second scissor arms 212. The second scissor arms 212 are symmetrically provided at two sides of the first scissor arm 211.

It is to be noted that the scissor set 2 includes a single-arm scissor set and a dual-arm scissor set. Compared with the single-arm scissor set (one second scissor arm 212) in Embodiment 1, there are two second scissor arms 212 in the embodiment. The dual-arm scissor set 2 is structurally more stable than the single-arm scissor set 2.

The above descriptions are merely preferred embodiments of the present disclosure, and are not intended to limit the present disclosure. Any modification, equivalent substitute and improvement without departing from the spirit and principle of the present disclosure shall be included within the protection scope of the present disclosure.

What is claimed is:

1. An armrest frame capable of being collapsed conveniently, comprising:

an armrest frame set, scissor sets, and a locking unit, wherein the armrest frame set comprises two parallel and vertically provided armrest frames;

the scissor sets are provided between the armrest frames, the scissor sets drive the armrest frames to move close to or away from each other, the scissor sets each comprises crisscross hinged scissor arms, and two ends of each of the scissor arms are respectively hinged to the corresponding armrest frames;

the locking unit is provided at a hinged position for the armrest frame and the scissor arm, and the locking unit locks the expanded armrest frame set;

wherein the scissor arm comprises a first scissor arm with a hinged central position and a second scissor arm; and an adjusting groove is formed at a position of one end of each of the first scissor arm and the second scissor arm hinged to the armrest frame, and the locking unit is provided at the adjusting groove of the second scissor arm.

2. The armrest frame capable of being collapsed conveniently according to claim 1, wherein the armrest frame is shaped as a square frame or a square plate.

3. The armrest frame capable of being collapsed conveniently according to claim 1, wherein there are two symmetrical scissor sets.

4. The armrest frame capable of being collapsed conveniently according to claim 1, wherein the locking unit comprises a clamping jaw and a locating post;

the clamping jaw is swingably provided on the scissor arm, and a spring member for driving the clamping jaw to reset is provided on the clamping jaw; and the locating post is provided on the armrest frame, and after the locating post and the clamping jaw are located cooperatively, the armrest frame is fixed.

5. The armrest frame capable of being collapsed conveniently according to claim 4, wherein a clamping groove correspondingly cooperated with the locating post is formed in the clamping jaw, the clamping groove is shaped as a semicircle, and the clamping jaw is provided with a protrusive limiting portion from the clamping groove to an extension direction of the corresponding scissor arm.

6. The armrest frame capable of being collapsed conveniently according to claim 4, wherein the locating post is located at the hinged position for the scissor arm and the armrest frame.

7. An armrest frame capable of being collapsed conveniently, comprising:

an armrest frame set, scissor sets, and a locking unit, wherein the armrest frame set comprises two parallel and vertically provided armrest frames;

the scissor sets are provided between the armrest frames, the scissor sets drive the armrest frames to move close to or away from each other, the scissor sets each comprises crisscross hinged scissor arms, and two ends of each of the scissor arms are respectively hinged to the corresponding armrest frames;

the locking unit is provided at a hinged position for the armrest frame and the scissor arm, and the locking unit locks the expanded armrest frame set;

wherein the scissor arm comprises the first scissor arm with the hinged central position and two second scissor arms, and the second scissor arms are symmetrically provided at two sides of the first scissor arm; and an adjusting groove is formed at a position of one end of each of the first scissor arm and the second scissor arm hinged to the armrest frame, and the locking unit is provided at the adjusting groove of the second scissor arm.

8. An armrest frame capable of being collapsed conveniently, comprising:

an armrest frame set, scissor sets, and a locking unit, wherein the armrest frame set comprises two parallel and vertically provided armrest frames;

the scissor sets are provided between the armrest frames, the scissor sets drive the armrest frames to move close to or away from each other, the scissor sets each comprises crisscross hinged scissor arms, and two ends of each of the scissor arms are respectively hinged to the corresponding armrest frames;

the locking unit is provided at a hinged position for the armrest frame and the scissor arm, and the locking unit locks the expanded armrest frame set;

wherein the scissor arm comprises the first scissor arm with the hinged central position and two second scissor arms, and the second scissor arms are symmetrically provided at two sides of the first scissor arm;

the locking unit comprises a clamping jaw and a locating post;

the clamping jaw is swingably provided on the scissor arm, and a spring member for driving the clamping jaw to reset is provided on the clamping jaw; and the locating post is provided on the armrest frame, and after the locating post and the clamping jaw are located cooperatively, the armrest frame is fixed.

* * * * *